United States Patent [19]

Murata et al.

[11] 4,259,215

[45] Mar. 31, 1981

[54] DETERGENT COMPOSITION CONTAINING A FABRIC SOFTENING CATIONIC SURFACTANT AND AN ETHER SULFATE HAVING A SPECIFIC OXYALKYLENE GROUP

[75] Inventors: Moriyasu Murata, Chiba; Akira Suzuki, Funabashi, both of Japan

[73] Assignee: Kao Soap Co., Ltd., Tokyo, Japan

[21] Appl. No.: 158,437

[22] Filed: Jun. 11, 1980

[30] Foreign Application Priority Data

Jun. 29, 1979 [JP] Japan ..... 54-82185

[51] Int. Cl.[3] ..... C11D 1/65; C11D 1/29

[52] U.S. Cl. ..... 252/528; 252/8.75; 252/532; 252/547; 252/551

[58] Field of Search ..... 252/547, 551, 528, 532, 252/8.75

[56] References Cited

U.S. PATENT DOCUMENTS

| | | | |
|---|---|---|---|
| 3,684,736 | 8/1972 | Groves et al. | 252/547 X |
| 3,843,706 | 10/1974 | Weil et al. | 252/551 X |
| 3,931,271 | 1/1976 | Baumann et al. | 252/551 X |
| 4,000,077 | 12/1976 | Wixon | 252/8.75 |
| 4,058,489 | 11/1977 | Hellsten | 252/547 |
| 4,132,678 | 1/1979 | Iijima et al. | 252/547 X |

*Primary Examiner*—Harris A. Pitlick

*Attorney, Agent, or Firm*—Blanchard, Flynn, Thiel, Boutell & Tanis

[57] ABSTRACT

A detergent composition for cleaning and improving the feel of clothes comprising from 0.5 to 20% by weight of cationic surfactant for imparting a fabric softening effect to clothes and from 0.2 to 4 parts by weight, per one part by weight of said cationic surfactant of an alkyl or alkenyl ether sulfate having oxypropylene and/or oxybutylene groups in the molecule.

9 Claims, No Drawings

DETERGENT COMPOSITION CONTAINING A FABRIC SOFTENING CATIONIC SURFACTANT AND AN ETHER SULFATE HAVING A SPECIFIC OXYALKYLENE GROUP

The present invention relates to a detergent composition. More particularly, the present invention relates to a detergent composition which possesses an excellent recontamination-preventing effect.

Household treatments for cleaning and improving the feel of clothes have heretofore been carried out by a two-step process in which, in the first step, soils and stains are removed by a detergent and, in the second step, the clothes are dipped in a clean water bath containing, dissolved therein, a feel improving agent such as a fabric softening agent or an antistatic agent. Recently, washing and treating agent compositions that make possible simultaneous performance of the washing step and the feel improving step have been developed. From the viewpoint of shortening the washing time and from the economical viewpoint, the demand for such products has been increasing. However, because the commercially available products contain a cationic surfactant as the feel improving agent, for example, a soft finishing agent, there arises the problem that previously removed soils or stains may become re-attached to the fabric in the washing bath, that is, recontamination of the fabric may occur.

We have studied the prevention of recontamination using a detergent containing a cationic surfactant as the feel improving agent. As a result, we have discovered that if a cationic surfactant is used in combination with a specific anionic surfactant and a complex of the anionic surfactant and the cationic surfactant is formed, a high recontamination preventing effect can be obtained without reduction of the desired feel improving effect on the fabric.

More specifically, in accordance with the present invention, there is provided a detergent composition comprising a cationic surfactant and, as an anionic surfactant, an alkyl or alkenyl ether sulfuric acid ester salt containing a specific oxyalkylene group, which is represented by the following general formula (1):

$$R—O—A—SO_3M \quad (1)$$

wherein R stands for a linear or branched, primary or secondary alkyl or alkenyl group having 8 to 22 carbon atoms, A stands for a polyoxyalkylene group containing oxypropylene and/or oxybutylene groups, in which the average number of the total polyoxyalkylene groups is from 0.5 to 30, and M stands for an alkali metal, an alkaline earth metal or an alkanolamine having 2 or 3 carbon atoms.

It is critical that the specific alkyl or alkenyl sulfuric acid ester salt having specific oxyalkylene groups, which is represented by the general formula (1), should be contained in an amount of 0.2 to 4 parts by weight, preferably 1 to 3 parts by weight, per one part by weight of the cationic surfactant. The cationic surfactant is incorporated in an amount of 0.5 to 20% by weight, preferably 1 to 5% by weight, based on the total weight of the detergent composition.

The oxyalkylene group (A) of the alkyl or alkenyl ether sulfuric acid ester salt of formula (1), includes oxypropylene and/or oxybutylene groups. The conventionally used oxyethylene groups can optionally also be included in the formula (1) material. The ratio of the number of moles of the oxypropylene groups and the oxybutylene groups and the ratio of the number of moles of the oxyethylene groups optionally included therein are not particularly critical.

Concerning the oxypropylene and oxybutylene groups used as the specific oxyalkylene groups in the oxyalkylene chain (A), oxypropylene groups are preferred, and combinations of oxyethylene and oxypropylene groups are especially preferred. The compounds of general formula (1) are industrially obtained in the form of a mixture in which the total number of oxyalkylene groups differs from molecule to molecule. The average number of the total oxyalkylene groups is 0.5 to 30, preferably 1 to 10. When oxyethylene groups are added, the ratio of oxyethylene groups to oxypropylene and/or oxybutylene groups is preferably in the range of from 1/4 to 4/1 and the average total oxyalkylene group number is preferably from 1 to 10.

The specific alkyl or alkenyl ether sulfuric acid ester salt containing specific oxyalkylene groups, which is represented by the general formula (1), is obtained by condensing at least one higher alcohol with at least one alkylene oxide, esterifying the condensate with sulfuric acid and neutralizing the ester with an alkali. Either an alkali catalyst or an acid catalyst can be used as the catalyst for the alkylene oxide condensation. Both natural higher alcohols and synthetic higher alcohols can be used as the starting higher alcohol. Primary and secondary synthetic higher alcohols can be used, but an oxo process synthetic higher alcohol (having an iso ratio of 20 to 80%) is most preferred, and a straight linear higher alcohol (higher alcohol derived from coconut oil or beef tallow) is second most preferred. More specifically, in the case of a liquid detergent composition, an oxo process synthetic higher alcohol having an average carbon number of 10 to 14 and an iso ratio of at least 30% is preferred. In the case of a powder detergent composition, a higher alcohol having an average carbon number of 12 to 18 is preferred.

As preferred examples of the counter ion M in the general formula (1), there can be mentioned sodium, potassium, monoethanolamine, diethanolamine, triethanolamine and magnesium.

As preferred examples of the specific alkyl or alkenyl sulfuric acid ester salt having the specific oxyalkylene groups, which is represented by the general formula (1), there can be mentioned compounds represented by the following general formulae (2) to (7):

| | |
|---|---|
| $R_1O(PO)_{m1}SO_3M_1$ | (2) |
| $R_1O(PO)_{m2}(EO)_{m3}SO_3M_1$ | (3) |
| $R_1O(BO)_{m2}(EO)_{m3}SO_3M_1$ | (4) |
| $R_1O(PO,EO)_{m1}SO_3M_1$ | (5) |
| $R_1O(BO)_{m1}SO_3M_1$ | (6) and |
| $R_1O(PO,EO,BO)_{m1}SO_3M_1$ | (7) |

wherein $R_1O$ stands for an alkyloxy and/or alkenyloxy residue of a coconut oil-derived higher alcohol, a beef tallow-derived higher alcohol, an oxo process synthetic higher alcohol (having an iso ratio of 20 to 80%) or a synthetic secondary higher alcohol, PO stands for an oxypropylene group, BO stands for an oxybutylene groups, EO stands for an oxyethylene group, m1 is a number of from 1 to 10, the sum of m2 and m3 is in the range of from 1 to 10, the ratio of m2/m3 is in the range of from 4/1 to 1/4, (PO,EO) and (PO,EO,BO) stand for randomly arranged cumulative oxyalkylene group assemblies, and $M_1$ stands for sodium, potassium, monoethanolamine, diethanolamine, triethanolamine or magnesium.

The cationic surfactants that can be used in the present invention are not particularly critical. For example, the following cationic surfactants can be used in the present invention.

(a) Di-(long-chain alkyl) quaternary ammonium salts represented by the following general formula:

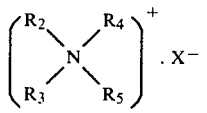

wherein $R_2$ and $R_3$ stand for an alkyl group having 10 to 26 carbon atoms, preferably 14 to 20 carbon atoms, $R_4$ and $R_5$ stand for an alkyl group having 1 to 5 carbon atoms, preferably 1 or 2 carbon atoms, and X stands for a halogen atom or a methyl sulfate or ethyl sulfate group (the same definitions will apply hereinafter).

(b) Mono-(long-chain alkyl) quaternary ammonium salts represented by the following general formula:

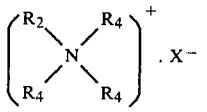

(c) Di-(long-chain alkyl)polyoxyethylene quaternary ammonium salts represented by the following general formula:

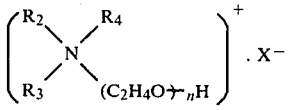

wherein n is a number of 1 to 20, preferably 1 to 10 (the same definition will apply hereinafter), or

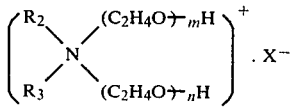

wherein m is a number of 1 to 20, preferably 1 to 10 (the same definition will apply hereinafter).

(d) Mono-(long-chain alkyl)polyoxyethylene quaternary ammonium salts represented by the following general formula:

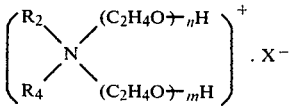

(e) Bis-(hydroxyalkyl) quaternary ammonium salts represented by the following general formula:

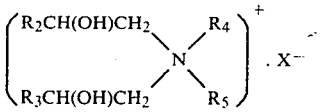

(f) Quaternary ammonium salts having an amide or ester linkage, such as reaction products of compounds represented by the following general formula:

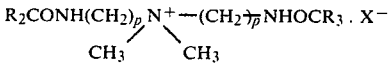

wherein p is a number of 1 to 5, preferably 2 or 3 (the same definition will apply hereinafter), with compounds represented by the following general formula:

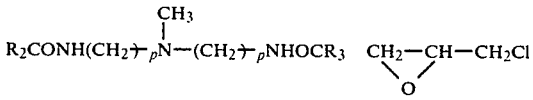

and quaternary ammonium salts represented by the following general formula:

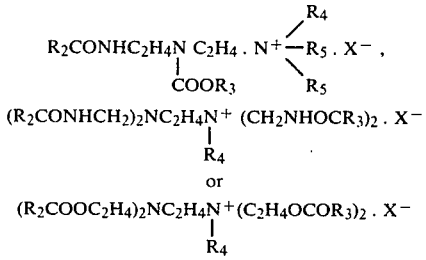

(g) Cationic polyamide compounds prepared by reacting 1 mole of diethylene triamine or dipropylene triamine with about 2 moles of a fatty acid having 12 to 24 carbon atoms to obtain a condensate having an acid value smaller than 10, adding about 1 to about 2 moles of epichlorohydrin to the thus-obtained condensate, subjecting the adduct to ring-opening polymerization in the presence of an alkaline agent and neutralizing the formed polymer with a monobasic acid in an amount of 0.3 to 1.5 moles per mole of said amine.

(h) Di-quaternary salts represented by the following general formula:

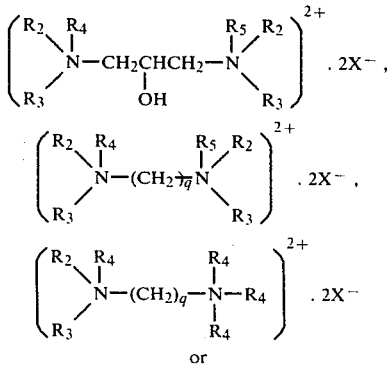

-continued

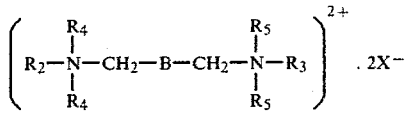

wherein q is a number of 2 to 8 and B stands for the group

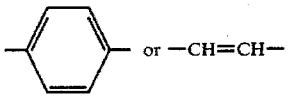

(the same definitions will apply hereinafter).

(i) Poly(N,N-dimethyl-3,5-methylenepiperidinium chlorides) having an average molecular weight of 1000 to 500000, which are represented by the following general formula:

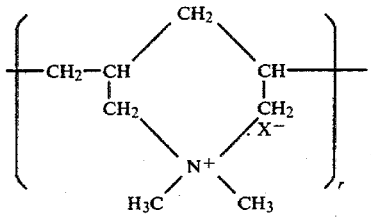

wherein r stands for the total number of the monomer units.

(j) Products obtained by quaternizing a vinylpyrrolidonedimethylaminoethyl methacrylate copolymer with dimethyl sulfate, which have a molecular weight of 1000 to 500000 and are represented by the following general formula:

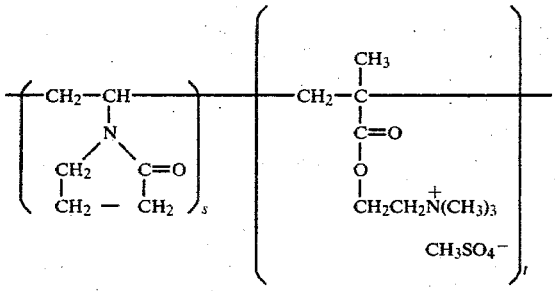

wherein s and t each stand for the total number of the monomer units.

(k) Products obtained by adding trimethylamine to an adduct of epichlorohydrin to hydroxyethyl cellulose to effect quaternization, which have a molecular weight of 200000 to 1000000 and are represented by the following general formula:

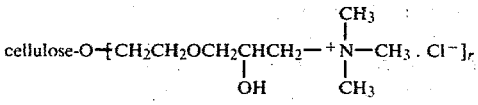

(l) Aminoethyl acrylate phosphate/acrylate copolymers having a molecular weight of 1000 to 500000, which are represented by the following general formula:

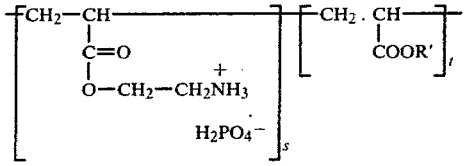

(m) Products obtained by adding trimethylamine to an adduct of epichlorohydrin to starch to effect quaternization, which are represented by the following general formula:

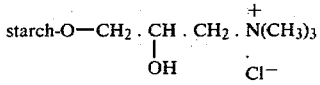

Among the foregoing cationic compounds, quaternary ammonium salts (a), (b), (c) and (d) are preferred. More specifically, as preferred cationic compounds, there can be maintained di-(beef tallow-alkyl)dimethyl ammonium chloride, mono-(beef tallow-alkyl)trimethyl ammonium chloride, di-(beef tallow-alkyl)dipolyoxyethylene ammonium chloride and mono-(beef tallow-alkyl)monomethyldipolyoxyethylene ammonium chloride.

A powdery or liquid detergent composition for clothes comprising the above-mentioned critical ingredients, according to the present invention, can additionally contain one or more of various anionic surface active agents and amphoteric surface active agents (1) to (9) described below, in amounts of 1 to 50% by weight, preferably 5 to 40% by weight. As the counter ion of the anionic surface active agents, there can be mentioned, for example, ions of alkali metals such as sodium and potassium, ions of alkaline earth metals such as calcium and magnesium, an ammonium ion, and alkanolamines containing 1 to 3 alkanol groups having 2 or 3 carbon atoms, such as monoethanolamine, diethanolamine, triethanolamine and triisopropanolamine.

(1) Linear or branched alkylbenzene sulfonate salts containing an alkyl group having 10 to 16 carbon atoms on the average.

(2) Alkyl- or alkenyl-ethoxy sulfate salts containing a linear or branched alkyl or alkenyl group having 10 to 20 carbon atoms on the average and having 0.5 to 8 moles of added ethylene oxide units on the average in one molecule.

(3) Alkyl or alkenyl sulfate salts containing an alkyl or alkenyl group having 10 to 20 carbon atoms on the average.

(4) Olefin sulfonate salts containing 10 to 20 carbon atoms on the average in one molecule.

(5) Alkane sulfonate salts containing 10 to 20 carbon atoms on the average in one molecule.

(6) Saturated or unsaturated fatty acid salts having 10 to 24 carbon atoms on the average in one molecule.

(7) Alkyl or alkenyl ether carboxylate salts containing an alkyl or alkenyl group having 10 to 20 carbon atoms on the average and having 0.5 to 8 moles of added ethylene oxide units, propylene oxide units, butylene oxide units, mixed ethylene oxide and propylene oxide units (molar ratio of 0.1/9.9 to 9.9/0.1) or mixed ethylene oxide and butylene oxide units (molar ratio of from 0.1/9.9 to 9.9/0.1) on the average in one molecule.

(8) α-Sulfo-fatty acid salts or esters represented by the following general formula:

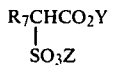

wherein Y stands for an alkyl group having 1 to 3 alkyl groups or a counter ion as described above with respect to the anionic surface active agents, Z stands for a counter ion as described above with respect to the anionic surface active agents, and $R_7$ stands for an alkyl or alkenyl group having 10 to 20 carbon atoms.

(9) Amphoteric surface active agents represented by the following general formula:

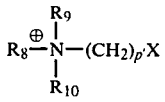

wherein $R_8$ stands for an alkyl or alkenyl group having 10 to 20 carbon atoms, $R_9$ and $R_{10}$ each stand for an alkyl group having 1 to 4 carbon atoms, p' is an integer of from 1 to 3, and X stands for a group —COO⊖ or —$SO_3$⊖.

In the present invention, a nonionic surface active agent can be incorporated as an optional ingredient. Ordinary nonionic surface active agents customarily used for detergent compositions can be used without any particular limitation. For example, the following nonionic surface active agents can be mentioned.

(A) Polyoxyethylene alkyl or alkenyl ethers containing an alkyl or alkenyl group having 10 to 20 carbon atoms on the average and having 1 to 20 moles of added ethylene oxide units.

(B) Polyoxyethylene alkylphenyl ethers containing an alkyl group having 6 to 12 carbon atoms on the average and having 1 to 20 moles of added ethylene oxide units.

(C) Polyoxypropylene alkyl or alkenyl ethers containing an alkyl or alkenyl group having 10 to 20 carbon atoms on the average and having 1 to 20 moles of added propylene oxide units.

(D) Polyoxybutylene alkyl or alkenyl ethers containing an alkyl or alkenyl group having 10 to 20 carbon atoms on the average and having 1 to 20 moles of added butylene oxide units.

(E) Nonionic surfactants containing an alkyl or alkenyl group having 10 to 20 carbon atoms on the average and 1 to 30 moles of added ethylene oxide and propylene oxide units or added ethylene oxide and butylene oxide units (the molar ratio of the ethylene oxide units to the propylene oxide or butylene oxide units is in the range of from 0.1/9.9 to 9.9/0.1).

(F) Higher fatty acid alkanolamides and alkylene oxide adducts thereof, which are represented by the following general formula:

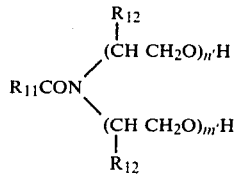

wherein $R_{11}$ stands for an alkyl or alkenyl group having 10 to 20 carbon atoms, $R_{12}$ stands for H or $CH_3$, n' is an integer of from 1 to 3, and m' is an integer of from 0 to 3.

(G) Sucrose fatty acid esters consisting of sucrose and a fatty acid having 10 to 20 carbon atoms on the average.

(H) Fatty acid glycerine monoesters consisting of glycerin and a fatty acid having 10 to 20 carbon atoms on the average.

(I) Alkylamine oxides represented by the following general formula:

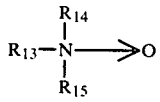

wherein $R_{13}$ stands for an alkyl or alkenyl group having 10 to 20 carbon atoms, and $R_{14}$ and $R_{15}$ each stand for an alkyl group having 1 to 3 carbon atoms.

In addition to the above-mentioned critical ingredients, the detergent composition of the present invention may further comprise up to 50% by weight of one or more alkali metal salts as builder salts. As such builder salts, there can be mentioned, for example, condensed phosphoric acid salts such as tripolyphosphoric acid salts, pyrophosphoric acid salts and metaphosphoric acid salts, aminopolyacetic acid salts, nitrilotriacetic acid salts, ethylene-diamine-tetraacetic acid salts and diethylene-triamine-pentaacetic acid salts, hydroxycarboxylic acid salts such as citric acid salts, malic acid salts and glycollic acid salts, and polymeric electrolytes such as salts of alkali hydrolysis products of polyacrylic acid and vinyl acetate-maleic anhydride copolymers.

One or more alkali metal salts, such as alkali metal silicates, carbonates and sulfates, can be incorporated as an alkaline agent or an inorganic electrolyte, in amounts of 1 to 50% by weight, preferably 5 to 30% by weight, based on the total weight of the composition. Moreover, alkanolamines represented by triethanolamine, diethanolamine, monoethanolamine and triisopropanolamine can be incorporated as organic alkaline agents.

Still further, one or more recontamination preventing agents such as polyethylene glycol, polyvinyl alcohol, polyvinylpyrrolidone and carboxymethyl cellulose can be incorporated in amounts of 0.1 to 5% by weight based on the composition.

Furthermore, bleaching agents such as sodium percarbonate, sodium perborate, sodium sulfate and sodium chloride-hydrogen peroxide adducts, whitening agents such as commercially available fluorescent dyes, and other additives such as perfumes, enzymes and bluing agents can be incorporated in the composition of the present invention according to need.

Moreover, talc, finely divided silica, clay, calcium silicate (for example, Microcell manufactured by Johns-Manvill Co.) and zeolites having a divalent metal ion exchange capacity, which are described below, can be incorporated as a water-insoluble substance, according to need. As the zeolites, there can be mentioned, for example, crystalline and/or amorphous aluminosilicates represented by the following formula (u):

$$x(M_2O).Al_2O_3.y(SiO_2).w(H_2O) \quad (u)$$

wherein M stands for sodium and/or potassium, and x, y and w are the mole numbers of the respective components, which satisfy the requirements of $0.7 \leqq x \leqq 1.2$ and $1.6 \leqq y \leqq 2.8$, and w being an optional positive number inclusive of 0, and crystalline and/or amorphous zeolites represented by the following formula (v):

$$X(M_2O).Al_2O_3.Y(SiO_2).Z(P_2O_5).W(H_2O) \quad (v)$$

wherein M stands for Na or K, and X, Y, Z and W are mole numbers of the respective components, which satisfy the requirements of $0.20 \leqq X \leqq 1.10$, $0.20 \leqq Y \leqq 4.00$ and $0.001 \leqq Z \leqq 0.80$, and W being an optional positive number inclusive of 0.

Fluorescent dyes, for example, those represented by the following structural formulae (w), (x) and (y), can be incorporated:

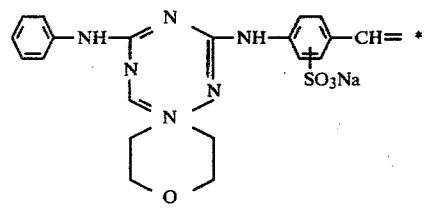

(w),

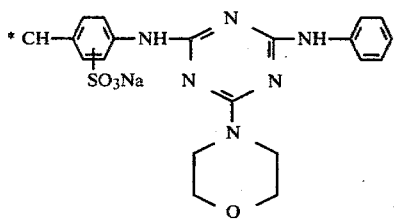

(x)

and

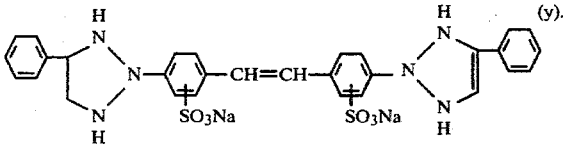

(y).

Furthermore, lower alcohols such as ethanol and isopropanol, glycols such as ethylene glycol and propylene glycol, urea, benzene-sulfonic acid salts, p-toluene-sulfonic acid salts, xylene-sulfonic acid salts, benzoic acid salts and salicylic acid salts can be incorporated as a viscosity reducing agent, and polyvinyl acetate, vinyl acetate-styrene copolymers and polystyrene can be incorporated as an opacifying agent.

Thus, a fabric-softening detergent having an excellent recontamination preventing effect can be provided according to the present invention.

The present invention will now be further described in detail with reference to the following illustrative Examples that by no means limit the scope of the invention. In these Examples, all references to "%" mean percent by weight.

In the Examples, the recontamination preventing test and softness test were carried out according to the following methods and the test results were evaluated according to the standards described below.

Recontamination preventing test

In 1 l of service water was dissolved 2.5 g of the detergent composition, and 0.20 g of carbon black was added to the solution and was uniformly dispersed therein by applying ultrasonic vibrations for 10 minutes. The thus-formed test bath was transferred into a washing tank of a Terg-O-Meter. Clean white test cloth specimens (10 cm×10 cm) were immersed in the bath and stirred at 25° C. for 15 minutes in the Terg-O-Meter. The bath was discharged and 1 l of clear service water maintained at 25° C. was added in its place and the specimens were stirred in the clear water for 5 minutes to effect rinsing. Then, the water was removed from the specimens by a centrifugal separator and the specimens were air-dried.

In the Examples, "wool", "acryl" and "cotton" indicate the following woven fabrics.

"wool": commercially available crimped white sweater

"acryl": acryl jersey knit wear

"cotton": white cloth formed by boiling and washing in water a shirting as defined by the Japanese Industrial Standard (JIS L-0206).

The whiteness of the tested specimen was examined and the recontamination preventing effect was evaluated as follows:

O: whiteness was the same as that of the original specimen before the test

X: the tested specimen was more black than the original specimen before the test Softness test Five sheets of acryl jersey (30 cm×60 cm) or one wool sweater (the same as used in the recontamination preventing test) were hand-washed with 5 l of an aqueous solution containing 0.25% of the detergent, which was maintained at 30° C. After air drying, the feel of the acryl jersey or wool sweater was examined by five experts and the softness was evaluated according to the following rating criteria.

A: softer than the specimen washed with the standard detergent

B: as soft as the specimen washed with the standard detergent

C: hard finish touch

EXAMPLE 1

Light-duty liquid detergent compositions comprising the following ingredients were prepared and subjected to the recontamination preventing test. The obtained results are shown in Table 1.

| Ingredients Incorporated | Amounts (%) |
|---|---|
| Secondary alcohol ethoxylate (average carbon number = 11, average added ethylene oxide mole number = 7) | 20 |
| Coconut fatty acid diethanolamide | 2 |
| Beef tallow-alkyl-trimethyl ammonium chloride | 1.5 |
| Recontamination preventing agent (polyoxyalkylene alkyl or alkenyl ether sulfuric acid ester salt or | 3.5 |

-continued

| Ingredients Incorporated | Amounts (%) |
|---|---|
| conventional recontamination preventing agent or surface active agent) (see Table 1) | |
| Ethanol | 5 |
| Water | 68 |

*In Table 1, PO stands for propylene oxide group, BO stands for propylene oxide group and EO stands for ethylene oxide group (the same definitions will apply hereinafter).

TABLE 1

| Recontamination Preventing Agent | Recontamination Preventing Effect |
|---|---|
| Present Invention | |
| $C_8H_{17}O(PO)_1SO_3Na$ | O |
| $C_{12}H_{25}O(PO)_3SO_3Na$ | O |
| R-beef tallow-$O(PO)_8SO_3Na$ | O |
| $R_1oxoO(PO)_{25}SO_3$ . triethanolamine | O |
| $R_2oxoO(PO)_4SO_3$ . triethanolamine | O |
| $R_3oxoO(PO)_{10}SO_3$ . Na | O |
| $R_4oxoO(PO)_{30}SO_3$ . Na | O |
| R-coconut-$O(PO)_3SO_3$ . Na | O |
| $R_1oxoO(PO)_8SO_3$ . $Mg_{\frac{1}{2}}$ | O |
| $R_1oxoO(PO)_8SO_3$ . $Ca_{\frac{1}{2}}$ | O |
| $C_8H_{17}O(BO)_1SO_3Na$ | O |
| $C_{12}H_{25}O(BO)_3SO_3Na$ | O |
| $R_1oxoO(BO)_3SO_3$ . triethanolamine | O |
| $C_{10}H_{23}O(PO)_1(EO)_1SO_3Na$ | O |
| $C_{12}H_{23}O(PO)_2(EO)_1SO_3Na$ | O |
| $R_1oxoO(PO)_2(EO)_1SO_3Na$ | O |
| $R_1oxoO(PO)_3(EO)_3SO_3Na$ | O |
| $R_1oxoO(PO)_3(EO)_8SO_3Na$ | O |
| $R_5oxoO(PO)_4(EO)_8SO_3Na$ | O |
| $R_1oxoO(EO)_3(PO)_2SO_3Na$ | O |
| $R_1oxoO(BO)_1(EO)_2SO_3Na$ | O |
| Comparison | |
| not added | X |
| $C_{12}H_{25}O(EO)_3SO_3Na$ | X |
| polyethylene glycol (molecular) weight = 6,000) | X |
| ethylene oxide-propylene oxide block copolymer (molecular weight = 2,000) | X |
| $R_1oxoO(EO)_9H$ | X |
| lauryl betaine | X |
| sodium linear-alkyl-benzene-sulfonate (average carbon number = 13) | X |
| $R_1oxoOSO_3Na$ | X |
| sodium α-olefin-sulfonate (average carbon number = 17 | X |
| sodium coconut fatty acid | X |
| sodium sulfosuccinate | X |
| carboxymethyl cellulose | X |
| sodium polyacrylate | X |

In the Table, "R-beef tallow-O" stands for a natural beef tallow-derived higher alcohol group, "R-coconut-O" stands for a natural coconut oil-derived higher alcohol group and "RoxoO" stands for an oxo process synthetic higher alcohol group, in which $R_1oxo$ is characterized by an average carbon number of 12 and an iso ratio of 35%, $R_2oxo$ is characterized by an average carbon number of 14 and an iso ratio of 36%, $R_3oxo$ is characterized by an average carbon number of 12 and an iso ratio of 50%, $R_4oxo$ is characterized by an average carbon number of 14 and an iso ratio of 21% and $R_5oxo$ is characterized by an average carbon number of 17 and an iso ratio of 71%.

EXAMPLE 2

A light-duty liquid detergent composition comprising the following ingredients was prepared and subjected to the recontamination preventing tests. The obtained results are shown in Table 2.

| Ingredients Incorporated | Amounts (%) |
|---|---|
| Secondary alcohol ethoxylate (same as used in Example 1) | 20 |
| Cationic surfactant (see Table 2) | 0 or 2 |
| $R_1oxoO(PO)_3(EO)_1SO_3Na$ | 5 |
| Ethanol | 10 |
| Water | balance |

TABLE 2

| Cationic Surfactant | Recontamination Preventing Effect |
|---|---|
| Comparison | |
| Not added | X |
| Present Invention | |
| R-beef tallow, $CH_3$ / $N^+$ / R-beef tallow, $CH_3$ . $Cl^-$ | O |
| R-beef tallow, $CH_3$ / $N^+$ / R-beef tallow, $(CH_2CH_2O)_8H$ $Cl^-$ | O |
| $C_{18}H_{37}$, $(C_2H_4O)_mH$ / $N^+$ / $CH_3$, $(C_2H_4O)_nH$ . $Cl^-$ (m + n = 8) | O |
| $C_{16}H_{33}CH(OH)CH_2$, $CH_3$ / $N^+$ / $C_{16}H_{33}CH(OH)CH_2$, $CH_3$ . $Cl^-$ | O |
| $CH_3$, $CH_3$ / R-beef tallow-$CONH(CH_2)_2N_+(CH_2)_2$—* / * $NHCOC_{16}H_{33}$ . $Cl^-$ | O |
| R-beef tallow-$CONHC_2H_4$ . N—$C_2H_4N^+$* / COOR-beef tallow / * $(CH_3)_3$ . $Cl^-$ | O |
| $(R\text{-beef tallow-}CONHCH_2)_2NC_2H_4N^+$ . * / $CH_3$ / * $(CH_2NHOCR\text{-beef tallow})_2Cl^-$ | O |
| $(R\text{-beef tallow-}COOC_2H_4)_2NC_2H_4N^+$ * / $CH_3$ / * $(C_2H_4OCOR\text{-eef tallow})_2Cl^-$ | O |
| cationic surfactant (g) | O |
| [R-beef tallow, $CH_3$ / N . $CH_2CHCH_2N^+$ * / OH / R-beef tallow] / * R-beef tallow, R-beef tallow ]$^{2+}$ $2Cl^-$ | O |
| cationic surfactant (i) | O |
| cationic surfactant (j) | O |
| cationic surfactant (k) | O |
| cationic surfactant (l) | O |
| cationic surfactant (m) | O |

Cationic surfactant (g):

Cationic polyamide compound was prepared by reacting 1 mole of diethylene triamine with 2 moles of hydrogenated beef tallow fatty acid to form a condensate having an acid value of 4.2), adding 1.5 moles of epichlorohydrin to the obtained condensate, subjecting the adduct to ring-opening polymerization in the presence of 0.2 mole of sodium hydroxide and neutralizing the resulting polymer with glycolic acid in an amount of 1.0 mole per mole of the abovementioned amine.

Cationic surfactant (i):

Merquat 100 manufactured by Merck Co.

Cationic surfactant (j):

Gafquat manufactured by GAF Co.

Cationic surfactant (k):

Polymer JR manufactured by Union Carbide Corporation

Cationic surfactant (l):

Cartex L manufactured by National Starch Co.

Cationic surfactant (m):

Excell manufactured by Nichiden Kagaku K.K.

EXAMPLE 3

A powdery detergent composition comprising the following ingredients was prepared and tested. The results shown in Table 3 were obtained.

| Ingredients Incorporated | Amounts (%) |
|---|---|
| Sodium linear-alkyl-benzene-sulfonate (average carbon number = 12) | 20 |
| Completely hardened beef tallow fatty acid sodium salt | 1 |
| Sodium tripolyphosphate | 8.7 |
| Sodium pyrophosphate | 4.7 |
| Sodium orthophosphate | 5.8 |
| Sodium silicate | 10 |
| Sodium carbonate | 5 |
| Polyethylene glycol (molecular weight = 6,000) | 1 |
| carboxymethyl cellulose | 1 |
| Zeolite of type 4A | 5 |
| Water | 10 |
| R—O—A—$SO_3M$ (see Table 3) | 2.5 |
| Cationic surfactant (see Table 3) | 2 |
| Glauber salt | balance |

TABLE 3

| Compound of General Formula (1) of R—O—A—$SO_3M$ | Cationic Surfacant | Recontamination Preventing Effect | Softening Effect |
|---|---|---|---|
| R; average carbon number of 14.5 and iso ratio of 36% A; $(PO)_1(EO)_2$ M; sodium | di-(beef tallow-alkyl) dimethyl ammonium chloride | O | A |
| not added | di-(beef tallow-alkyl) dimethyl ammonium chloride | X | standard |
| R; average carbon number of 18 and iso ratio of 0% A; $(PO,EO)_5$ M; sodium | di-(beef tallow-alkyl) dimethyl ammonium chloride | O | A |
| not added | di-(beef tallow-alkyl) dimethyl ammonium chloride | X | standard |

The embodiments of the invention in which an exclusive property or privilege is claimed are defined as follows:

1. A detergent composition for washing clothes and simultaneously imparting a fabric softening effect to the clothes, which consists essentially of:

from 0.5 to 20% by weight of cationic surfactant effective for imparting a fabric softening effect to clothes;

from 0.2 to 4 parts by weight, per one part by weight of said cationic surfactant, of one or a mixture of two or more surfactants having the formula $$R—O—(A)_m—SO_3M$$

wherein

R is alkyl or alkenyl having from 8 to 22 carbon atoms;

A is selected from the group consisting of oxypropylene, oxybutylene and oxyethylene, and m is from 0.5 to 30 on the average, with the proviso that at least about 20% of the A units are oxypropylene, oxybutylene or mixture thereof; and M is an alkali metal, alkaline earth metal or alkanolamine having 2 or 3 carbon atoms, the balance of the composition being conventional ingredients of liquid or granular detergent compositions.

2. A detergent composition as set forth in claim 1 wherein said anionic surfactant is selected from the group consisting of compounds having the formulae (2) to (7):

$$R_1O\text{-}(PO)_{m1}SO_3M_1 \quad (2)$$

$$R_1O\text{-}(PO)_{m2}(EO)_{m3}SO_3M_1 \quad (3)$$

$$R_1O\text{-}(BO)_{m2}(EO)_{m3}SO_3M_1 \quad (4)$$

$$R_1O\text{-}(PO,EO)_{m1}SO_3M_1 \quad (5)$$

$$R_1O\text{-}(BO)_{m1}SO_3M_1 \quad (6)$$

$$R_1O\text{-}(PO,EO,BO)_{m1}SO_3M_1 \quad (7)$$

wherein $R_1O$ is an alkyloxy and/or alkenyloxy residue of a coconut oil-derived higher alcohol, a beef tallow-derived higher alcohol, an oxo process synthetic higher alcohol having an iso ratio of 20 to 80% or a synthetic secondary higher alcohol, PO is oxypropylene, BO is oxybutylene, EO is oxyethylene, m1 is a number of from 1 to 10, the sum of m2 and m3 is in the range of from 1 to 10, the ratio of m2/m3 is in the range of from 4/1 to 1/4, (PO,EO) and (PO,EO,BO) are randomly arranged cumulative group assemblies, and $M_1$ is sodium, potassium, monoethanolamine, diethanolamine, triethanolamine or magnesium.

3. A detergent composition as set forth in claim 2 wherein $R_1O$ is a residue of an oxo process synthetic higher alcohol having an iso ratio of 20 to 80%.

4. A detergent composition as set forth in claim 2 wherein said anionic surfactant has the formula (2):

$$R_1O(PO)_{m1}SO_3M_1 \quad (2).$$

5. A detergent composition as set forth in claim 2 wherein said anionic surfactant has the formula (3):

$$R_1O(PO)_{m2}(EO)_{m3}SO_3M_1 \quad (3).$$

6. A detergent composition as set forth in claim 1, claim 2, claim 3, claim 4 or claim 5 wherein said cationic surfactant is selected from the group consisting of (a) di-(long-chain alkyl) quaternary ammonium salts, (b) mono-(long-chain alkyl) quaternary ammonium salts, (c) di-(long-chain alkyl)polyoxyethylene quaternary ammonium salts and (d) mono-(long-chain alkyl)-polyoxyethylene quaternary ammonium salts.

7. A detergent composition as set forth in claim 6 wherein the amount of said cationic surfactant is 1 to 5% by weight.

8. A detergent composition as set forth in claim 2 in which the balance of said detergent composition consists essentially of up to 50% by weight of anionic synthetic water-soluble organic surfactant effective for washing clothes and different from said anionic surfactant of formula (1), amphoteric synthetic, water-soluble organic surfactant effective for washing clothes, nonionic synthetic, water-soluble organic surfactant effective for washing clothes or mixture thereof; up to 50% by weight of water-soluble builder salts for detergents, water-soluble polymeric polyelectrolytes for detergents or mixture thereof; up to 50% by weight of water-soluble inorganic alkaline agent for detergents, water-soluble organic alkaline agent for detergents or mixture thereof; and water.

9. A detergent composition as set forth in claim 8 containing from 5 to 40% by weight of said synthetic water-soluble organic surfactant; from 5 to 30% by weight of alkali metal salts selected from the group consisting of alkali metal silicates, alkali metal carbonates and alkali metal sulfates.

* * * * *